United States Patent [19]

Hudgens et al.

[11] Patent Number: 4,832,677

[45] Date of Patent: May 23, 1989

[54] METHOD AND APPARATUS FOR PRODUCING DRAW TAPE BAGS

[75] Inventors: Mark Hudgens, Smyrna; James R. Johnson, Chamblee, both of Ga.

[73] Assignee: AMI, Inc., Doraville, Ga.

[21] Appl. No.: 47,677

[22] Filed: May 8, 1987

Related U.S. Application Data

[63] Continuation-in-part of Ser. No. 829,808, Feb. 14, 1986, Pat. No. 4,664,649.

[51] Int. Cl.[4] ..... B05B 1/14

[52] U.S. Cl. ..... 493/369; 493/196; 493/197; 493/232; 493/237; 493/225; 493/928; 83/424; 83/435; 83/671; 83/917

[58] Field of Search ..... 493/192, 197, 202, 225, 493/229, 232, 237, 365, 369, 928, 194, 196; 83/365, 671, 692, 911, 917, 350, 355, 424, 435

[56] References Cited

U.S. PATENT DOCUMENTS

| | | | |
|---|---|---|---|
| 1,946,457 | 2/1934 | Donnelley et al. | 83/365 |
| 2,519,201 | 8/1950 | Seidman | 83/371 |
| 2,859,814 | 11/1958 | Berney | 83/355 |
| 3,623,387 | 11/1971 | Mehnert | 83/355 |
| 3,782,233 | 1/1974 | Helm | 83/917 |
| 4,125,044 | 11/1978 | Carrigan et al. | 83/917 |
| 4,130,039 | 12/1978 | Heyden et al. | 83/355 |
| 4,688,455 | 8/1987 | Takehara | 83/424 |

*Primary Examiner*—Frederick R. Schmidt
*Assistant Examiner*—Robert Showalter
*Attorney, Agent, or Firm*—James B. Middleton

[57] ABSTRACT

A method and apparatus for forming draw tape bags wherein the bag material moves continuously during the manufacture, except for the last step. The apparatus may be used with an in-line system wherein a tube is extruded and a side gusset is formed to create a hem; or the apparatus may be used with an off-line system wherein folded bag material is used, and a continuous hemmer is provided to turn the loose edges. In the off-line system a constant tension dancer precedes the hemmer to maintain constant tension on the web regardless of the size of the supply roll. The web continues to move, and a cutter is actuated to move through a circle and engage the web to punch finger holes in the hem. A reel of a strip of material is continuously fed, the strip being slit longitudinally to provide the draw tapes which are inserted into the hems. A tape guide tensions the tape and assures that the tape is well within the hem, the hems are sealed, and the bags are side welded.

3 Claims, 4 Drawing Sheets

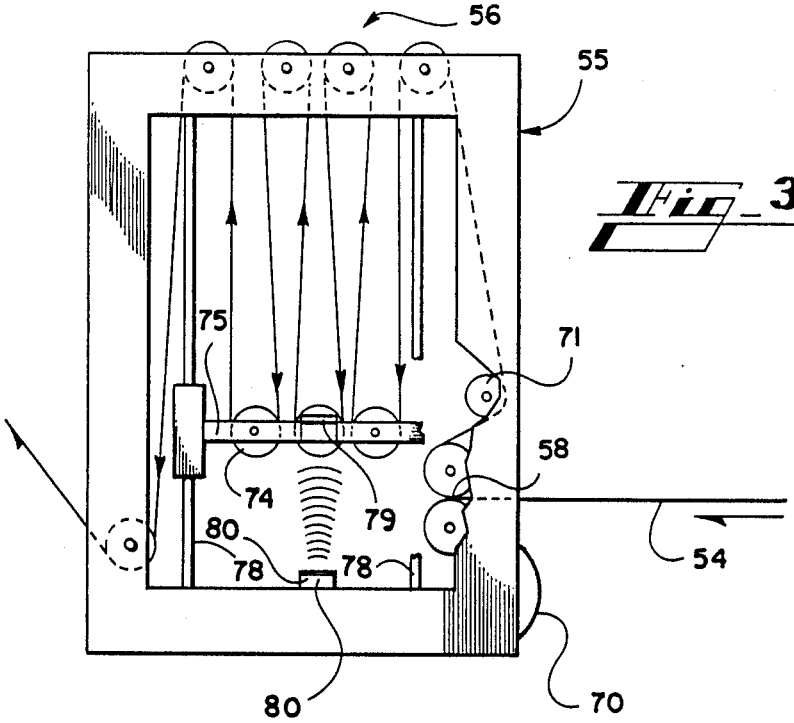
Fig_3
Fig_4
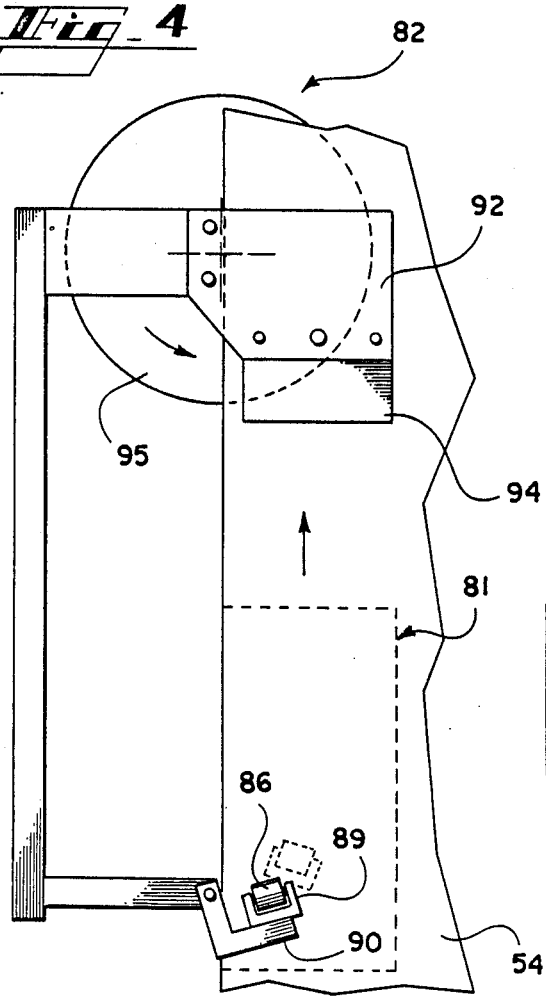
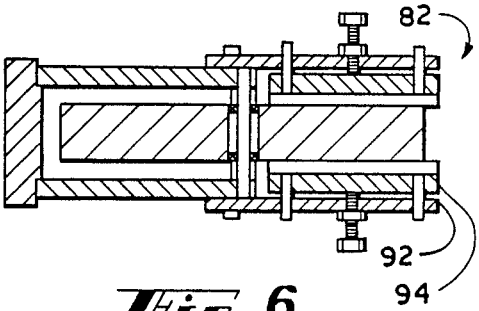
Fig_6
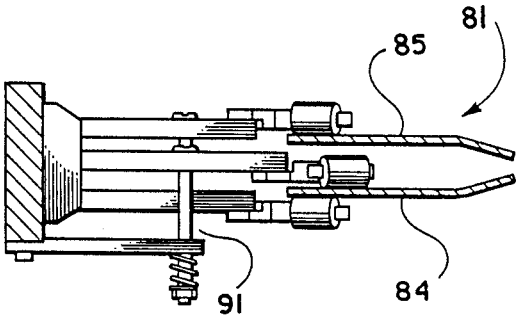
Fig_5

145
39
146
40
142
126
54
128
144
135
135
133
125
132
134
139
131
138
129
139
140
137
136
141
130

152
151
41
155
156
153
158
150

153
154
159
160
161

METHOD AND APPARATUS FOR PRODUCING DRAW TAPE BAGS

CROSS-REFERENCE TO RELATED APPLICATIONS

This is a continuation-in-part of the application by the same inventors filed Feb. 14, 1986, Ser. No. 829,808, which will issue as U.S. Pat. No. 4,664,649 on May 12, 1987.

INFORMATION DISCLOSURE STATEMENT

Drawstring bags have long been utilized, and have taken many forms in the past. While drawstring bags made of plastic have been utilized to some extent, such bags have been used mostly in the boutique bag, which tends to be a more expensive bag. Much of the reason for this limitation in the market area is the cost of producing a drawstring bag. The usual plastic drawstring bag requires several special steps because a string is normally used, and the string must be knotted, provided with a metal fastener, or otherwise fixed together. These processes cannot be carried out by the usual bag producing equipment.

More recently, there have been draw tape bags utilized, again, mostly in the boutique bag area. The draw tape bags represent a major advance in that a thermoplastic bag is provided with a thermoplastic tape so the tape can be heat sealed into the bag during the process of manufacture of the bag.

There are still numerous difficulties in the production of the draw tape bags. In the making of a draw tape bag, sheet material is generally purchased in rolls, and the roll is unwound, then an edge is turned in a hemming operation. After this point, the conventional machinery requires that the sheet material being fed be stopped for each operation, then restarted. Thus, the material must be stopped while a hole is punched, then the tape must be inserted following the hole punching operation. In conjunction with the tape insertion, of course there is the unwinding and splicing of the tape itself so a machine must handle two webs instead of only one. Next, the hem must be sealed, and both sides of the bag must have the hem sealed so that two sets of sealing bars are normally required. Finally, the individual bags are side sealed and separated from the continuous piece of material. The completed bag can then be removed for further processing.

One of the major difficulties in the conventional bag forming apparatus is in the requirement to stop and start the web because most of the equipment is of a reciprocating nature. As the processing line becomes longer, it will be obvious that the quantity of sheet material in the line is longer, and has a greater inertia. As the web is more and more difficult to stop and start, timing becomes more difficult and there is greater chance for error in all parts of the machinery.

SUMMARY OF THE INVENTION

The present invention relates generally to a method and apparatus for producing draw tape bags, and is more particularly concerned with a method and apparatus wherein more of the processing is handled in a continuous movement of the web, with only the final steps requiring the stopping and starting of the web.

The present invention provides a unique hemming arrangement, and means for punching holes in the hemmed edge while the web is continuously moving.

The draw tape is also inserted while the web moves continuously. The draw tape is stored on a large reel, and the tape is provided from a strip that is twice as wide as the final tape to provide a stable reel. The tape strip is slit as it is fed to the bag material to yield the proper tape. After the tape is inserted, a guide urges the tape into the hem. In the final steps, the web is pulled taut laterally, and a side sealing blade is used to side seal the bag in both the body area and the hemmed area, and to sever the individual bags.

The invention is usable with either in-line systems wherein the web is extruded and the bag making operation is continuous with the extrusion, or off-line systems wherein a folded web is provided and bags are produced from the web.

BRIEF DESCRIPTION OF THE DRAWINGS

These and other features and advantages of the present invention will become apparent from consideration of the following specification when taken in conjunction with the accompanying drawings in which:

FIG. 3 is a side elevational view, partially broken away, showing the constant tension means for the off-line system of FIG. 2;

FIG. 4 is a side elevational view of the hemming apparatus, for use in the line of FIG. 2, made in accordance with the present invention;

FIG. 5 is a cross-sectional view taken substantially along the line 5—5 in FIG. 4;

FIG. 6 is a cross-sectional view taken substantially along the line 6—6 in FIG. 4;

DETAILED DESCRIPTION OF THE EMBODIMENTS

Figures 1, 2:
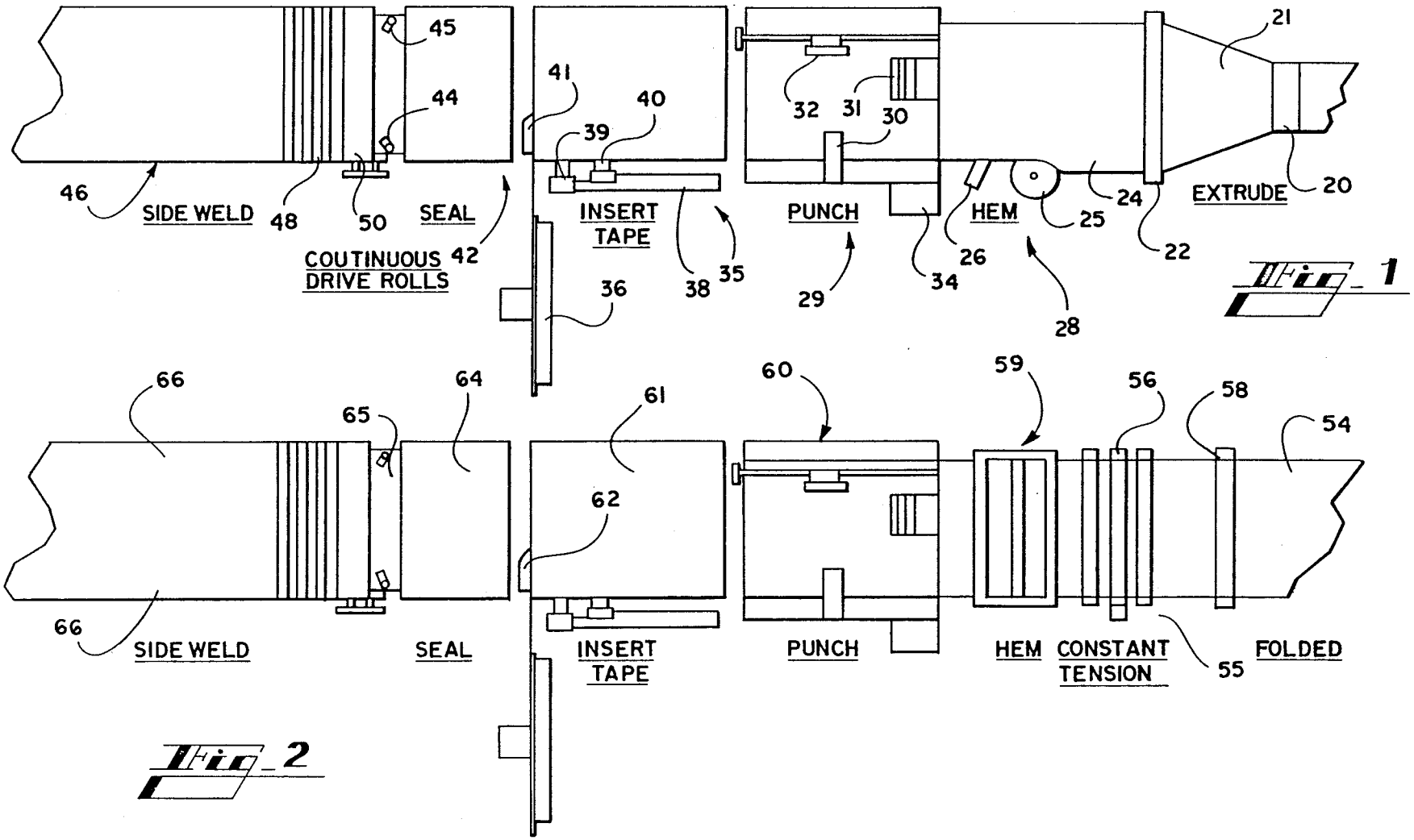
FIG. 1 is a somewhat schematic, top plan view showing bag forming apparatus made in accordance with the present invention, the apparatus being an in-line system.
FIG. 2 is a somewhat schematic, top plan view showing bag forming apparatus made in accordance with the present invention, the apparatus being an off-line system.

Referring now more particularly to the drawings and to those embodiments of the invention here presented by way of illustration, FIG. 1 shows an in-line bag producing line and FIG. 2 shows an off-line bag producing line. The two lines are quite similar, there being only certain areas that are somewhat different. Thus, the two lines will be described separately, then the individual pieces of apparatus will be described in detail thereafter.

Looking first at FIG. 1 of the drawings, the system of the present invention is shown in-line with an extruder 20. Those skilled in the art will understand that means are provided for feeding plastic material to a die, the die forming a tube 21 which is fed continuously from the extruder 20. This construction is well known, and the schematic representation and the above brief description should be sufficient.

After the extruded tube 21 is cooled enough that it will not seal to itself, the tube 21 is flattened by passing it between rolls such as the rolls 22. The flattened tube is then used as bag making stock indicated at 24.

The first step in the formation of a bag is the turning of hems in the top of the bag. Since the stock 24 has no loose edges, it is efficient to utilize a conventional gussetting wheel 25 to form a gusset in one edge of the stock 24. The gusset will of course be of a depth equal to the depth of the desired hem. Immediately following the gussetting wheel 25, a knife 26 slits the inner crease of the gusset. Thus, the gussetting wheel 25 and the knife 26 make up a hemming station generally designated at 28, and the result is a folded sheet material with inwardly turned hems at the upper edges.

The next step towards formation of the bags is the punching of holes in the material 24. The punching station is designated at 29 and includes a punch housing 30 through which the hemmed edge of the material travels. The punching station 29 also includes a measuring roll 31 and a photocell 32 for reading printed material on the material 24. A hole adjusting means is indicated at 34.

After the finger hole is punched at the punching station 29, the material is conveyed to the tape insertion station 35. A strip of material is stored on reels 36, the strip being twice as wide as the draw tape to be used in the finished bags. Thus, the strip handling apparatus is generally indicated at 38, the strip handling apparatus being adapted to slit the strip and feed the resulting two draw tapes into the upper and lower hems as is indicated at 39 and 40.

After the draw tapes 39 and 40 have been inserted into the hems, it will be understood that the tapes must be urged tightly into the hems before the hem is sealed. For this purpose, a tape guide 41 is provided. The tape guide 41 both urges the draw tape into the hems and tensions the draw tape.

From the draw tape insertion station 35, the material is passed to the hem sealer 42 which seals each hem to the proper side of the bag material. This is a continuous, longitudinal, seam; thus, there is not yet a separation between bags, but the draw tape is sealed within the hem for subsequent side welding operation.

After the hem sealer 42, the material is straightened laterally by rolls 44 and 45. These rolls assure that the material is flat and unwrinkled as the bag stock enters the bag machine 46. At the beginning of the bag machine 46 there is a conventional dancer 48 which is normally provided because the bag machine operates by stopping and starting the web whereas the earlier part of the machine operates continuously.

Since the apparatus under discussion is an in-line system, it will be understood that the extruder preferably operates continuously. If a problem develops in the line, the problem is most likely to be in the bag machine since this is a stop-start operation, and the balance of the line is a continuous process. It is most economical, therefore, to continue the operation in the rest of the system to prevent having to re-thread the entire system.

Following the hem sealer 42, and preceeding the bag machine 46, there are continuous-drive rolls 50. The drive rolls 50 will engage the material tightly and continue to drive the material 24 even when the bag machine 46 ceases operation. Thus, a problem in the bag machine 46 can be remedied, and only the bag machine must be re-threaded before production can be resumed. There will of course be a considerable amount of wasted bag material when the bag machine 46 develops a problem, but it is conventional to regrind this waste to be returned to the extruder 20.

Attention is now directed to FIG. 2 of the drawings which illustrates an off-line system. The off-line system requires the delivery to the system of a folded web which is commonly known as bag material. Many converters purchase bag material on rolls and perform only the subsequent operations.

In FIG. 2 the incoming bag material is designated at 54. While the folded sheet may be provided on a roll, it is equally within the concept of the present invention that a flat sheet may be provided on a roll, the sheet then being passed over a center folder to provide that bag material 54.

When a roll of material is fed to a processing system, it has been found that tension varies with the diameter of the supply roll. Thus, a new roll exerts one tension in the system; and, as the roll is used and diminished, the tension changes. While some materials may act the same at all times, it will be recognized that the polyethylene film most often used for bags will stretch under tension. With the length of the processing line, the varying amount of stretch will cause variations in the placement of holes, side seals, and relative tensions. Thus, the preferable system has the same tension at all times.

The bag material 54 is passed through a constant tension device 55 which comprises a dancer 56 in conjunction with driven feed rolls 58. The dancer 56 controls the feed rolls 58 to assure constant tension on the material as it leaves the dancer 56.

After the constant tension device 55, the material 54 goes through the hemming station 59 where the loose edges of the bag material 54 are turned inwardly for the desired hem. The material is then fed to the punching station designated at 60 as was described in connection with FIG. 1.

From the punching station, the bag material is treated the same as was previously described, passing through a tape insertion station 61 having a tape guide 62. The hems are then sealed at the sealing station 64, the material is straightened laterally at 65, and the bag material enters the bag machine 66. It will be noticed that the drive rolls 50 are omitted in the off-line system since the entire line can be stopped without exacerbation of the problem.

It will be realized that much of the system of the present invention is the same as in the above identified co-pending application of the same inventors, and that application is incorporated herein by this reference. The detailed description will therefore not be repeated except for clarity, and only the modified portions will otherwise be described in full.

With the foregoing description in mind, attention is directed to FIG. 3 of the drawings which shows the constant tension device 55 in more detail. It should also be understood that, while the constant tension device has been described in the off-line system of FIG. 2, if there is a problem with varying tension in the system of FIG. 1, the constant tension device 55 could equally well be used in that system.

In FIG. 3, the bag material 54 enters from the right, passing between the feed rolls 58. The feed rolls 58 are pressed tightly against each other to clamp the material 54 therebetween for a driving engagement. Though not here shown in detail, a drive motor 70 will drive the rolls 58 at the desired speed.

From the drive rolls 58, the material passes over an idler 71, then to the first roll 72 of the dancer 56. The dancer 56 has three rolls 74 that are suspended in the material 54, and four stationarily located rolls 72 for supporting the material 54. As is conventional, the material passes over a roll 72, down to and around a roll 74, then back up to a roll 72. The process is continued for all rolls. The result, then, is that the weight of the rolls 74 holds the loops in the material. If tension increases, the rolls 74 rise, and if tension decreases, the rolls 74 move down.

The three rolls 74 are connected together by a carriage 75; and, each end of the carriage carries a slide bearing 76. The slide bearings 76 are movable along guide rods 78. From the front of the center roll 74, a gauging flange 79 extends to reflect a control signal to the control 80.

The control 80 is of a type well known in the art, so only a brief description is required. A supersonic signal is propagated from the control 80, towards the flange 79, and the flange 79 reflects a signal back to the control 80. From the reflected signal, the control 80 determines the distance of the flange 79 from the control 80. A preferred distance is preset; and, if the distance is too great, the drive is increased in speed to allow slack and lower the carriage 75. If the distance is too small, the drive 70 is decreased in speed to take up slack and cause the carriage 75 to rise. The constant monitoring and adjusting will cause the drive 70 to maintain constant tension on the material 54.

The description of the hemming station 59 in the prior, co-pending application should be referred to for a complete understanding. Certain modifications have been made, and the new apparatus is shown in FIGS. 4–6 of the present drawings.

It will be remembered that the hemming apparatus turns a portion of the loose edge inwardly, then presses the crease to cause the hem to remain as set. The present apparatus is only slightly modified, the hem turning apparatus being indicated at 81 and the hem pressing apparatus being indicated at 82.

The hem turning apparatus 81 must be initially threaded by hand, the edges of the material being passed around the plates 84 and 85 to the desired extent. As the material passes through the bag making system, the material is further urged to maintain the desired hem.

It will be seen that a pair of rollers 86 and 88 is provided, the roller 86 being on the outside of the bag, and the roller 88 being on the inside of the bag. The roller 86 is held by a yoke 89 which is pivotally carried by an arm 90. Spring means 91 urges the arm 90 towards the plate 84.

With the roller 86 angled with respect to the movement of the material 54, it will be seen that the roller 86 will urge the material 54 to the left as viewed in FIG. 4. The complementary roller 88 is on the opposite side of the plate 84, and is angled oppositely to urge the material to the right as viewed in FIG. 4. The result is that the material will be pulled snuggly into the desired hem.

As is shown in FIG. 5 of the drawings, the entire assembly is duplicated for the opposite side of the bag. Since the construction and operation are the same, the description will not be repeated.

Following the hem turning apparatus 81, the hem pressing apparatus both assists in maintaining the hem and presses the hem. The pressing apparatus is shown in FIGS. 4 and 6.

Outwardly of the bag material 54, there is a support 92 carrying a slidable pad 94. The pad 94 is slidable towards and away from a rotating platen 95 to achieve the desired pressing.

The platen 95 is rotatable about a center 96 which is outside the hem in the bag material 54. Thus, as the material moves upward, across the platen 95, the platen 95 will be caused to rotate. Rotation of the platen 95 assists in urging the hem inwardly as the hem is pressed by the pad 94.

It should be noticed that the pad 94 is not urged against the platen 95 above the horizontal centerline of the platen. With this arrangement there is no appreciable tendency of the platen to urge the hem in the opposite direction.

As is more clearly shown in FIG. 6, the pad 94 is slidable on a plurality of pins 96, and is urged towards the platen 95 by a screw 98. This adjustment allows the same arrangement to be used on different materials having different thicknesses and other characteristics.

Returning briefly to FIGS. 1 and 2 of the drawings, it will be seen that the hole punching station 29 or 60 follows the hemming station 28 or 59. The material enters the punching station at the right as viewed in FIGS. 1 and 2, and it will be seen that there are measuring, or detection, means shown schematically at 31 and 32. The measuring means 31 is of a type well known in the art, and includes a wheel that rolls on the web as the web moves. Rotation of the wheel generates electrical signals at predetermined times so the device can be used to measure lengths of sheet material. In the present apparatus, the measuring device 31 can be used to measure the predetermined width of the bag in order to provide a signal to the punching apparatus to punch at the appropriate location.

It is common in the production of printed bags to utilize printed material to indicate the appropriate bag widths. For this technique, the sensing means 32 will be utilized in the present invention. The sensing means 32 is well known to those skilled in the art and includes a single unit having a light source and a light responsive means so that an electric signal can be generated on reading certain printed material. In the present invention, a signal from the sensing means will be utilized to actuate the punching means.

Figure 7:
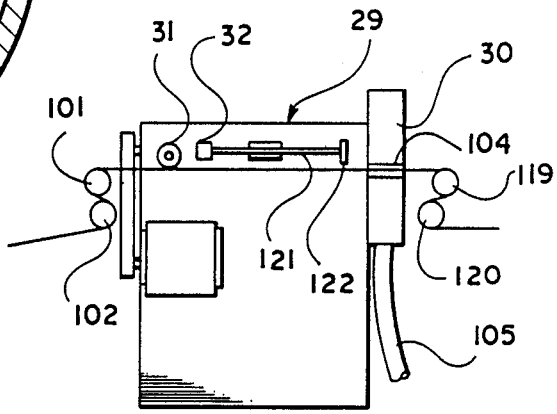
FIG. 7 is a rear elevational view showing the punching arrangement.

The punching apparatus shown in FIG. 7 may be used in either of the lines shown in FIGS. 1 and 2. For convenience in discussion, the punching station in FIG. 7 is designated at 29, and other parts carry the same numerals as in FIG. 1.

When plain sheet material is used as bag material, the punch will be activated on the basis of the measure taken by the wheel 31 and nothing further needs to be said. When printed web is used, however, it will be understood that any given pattern may be repeated in the bag so that the repeat of a pattern will not be an accurate gauge for punching. To resolve this difficulty, the linear measuring wheel 31 can be used in conjunction with the photocell 32 to activate the punch. Specifically, the measuring wheel 31 can be set for a width just short of the width of the bags being made. At the predetermined point, the photocell 32 will be energized. Then, the next appropriate pattern will be read and will activate the punch. It will be understood that the photocell will be activated in the clear space that normally occurs between bags, and the next printed spot of sufficient contrast will cause the punch to operate The punching means is indicated generally at 30 and is shown in more detail in FIGS. 7, 8 and 9. Looking at FIG. 7, it will be seen that the hemmed web 24 enters the punching station, and the wheel 31 is indicated as engaging the web, and the sensing means 32 is indicated as being closely adjacent for reading printed material thereon. The web continues across the punching station 29, held on guide rollers 101 and 102, and passes through a slot 104. A cutter cuts a hole at the desired time as the web passes through the slot 104, and scrap is discharged through the pipe 105.

Figure 8:
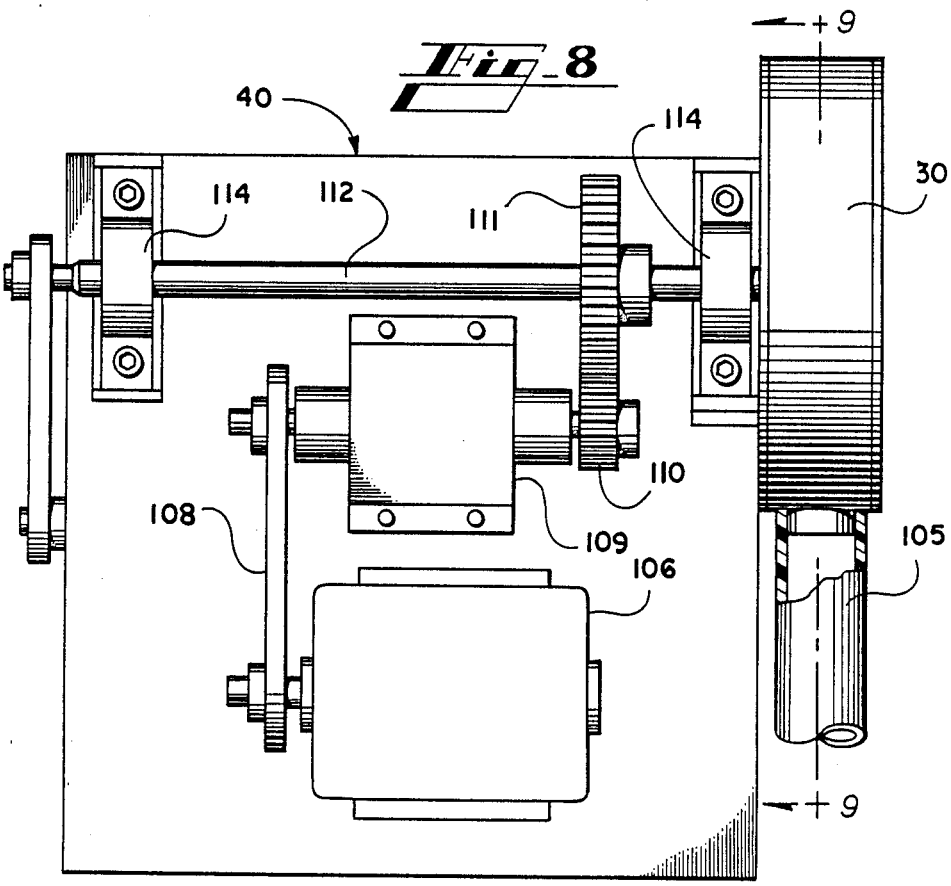
FIG. 8 enlarged elevational view taken from the opposite side of the apparatus shown in FIG. 7.

In FIG. 8 it will be seen that there is a drive motor 106 having a belt 108 connecting the motor 106 to an electrically operated clutch and brake apparatus 109. The output of the clutch assembly 109 includes a gear 110 that meshes with a gear 111 on the cutter drive shaft 112. The shaft 112 is appropriately journaled in bearings 114 and mounts a cutter arm at its end which extends into the cutter housing 30. It should therefore be understood by those skilled in the art that, during operation of the apparatus, the electric motor 106 will be running continuously to drive one side of the clutch and brake mechanism 109. When a hole is to be cut in the moving web, an electrical signal will be provided to the clutch and brake assembly 109 so the output will be connected to the input and cause rotation of the gear 110. Rotation of the gear 110 will cause rotation of the gear 111, hence the shaft 112, to cause a cutting stroke of the cutter.

Figure 9:
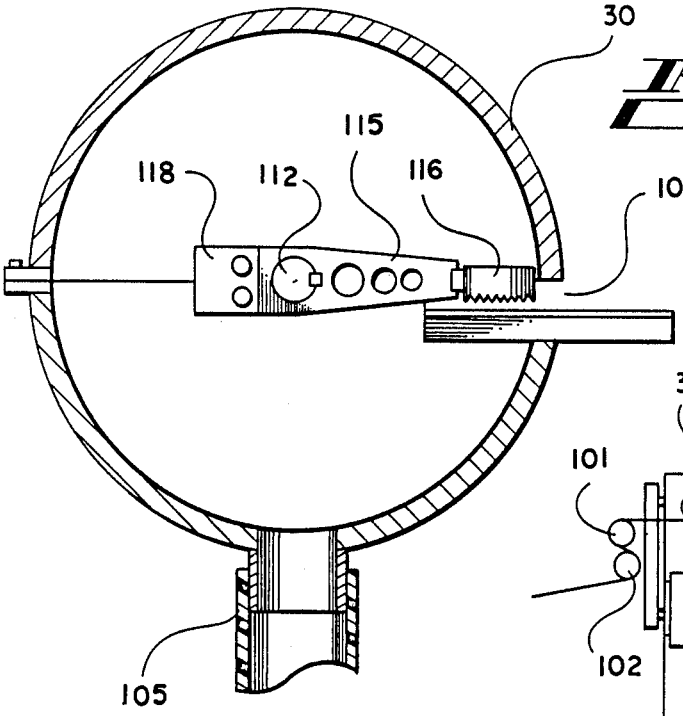
FIG. 9 is a cross-sectional view taken substantially along the line 9—9 in FIG. 8.

With the above in mind, attention is directed to FIG. 9 of the drawings which shows the interior of the cutter housing 30. It will be seen that the cutter includes an arm 115 carrying a cutter 116 at one end and weights 118 at the opposite end. With the arrangement shown, it should be well understood that the web will pass through the slot 104 with the hemmed edge of the web extending beneath the cutter 116.

While the cutter 116 is here shown in position immediately prior to making a cut through the web, it should be understood that the arm 115 will normally assume a position approximately 45° clockwise from the position shown. Thus, the "rest" position of the arm 115 will place the cutter below the web; then, when a punch cycle starts, the arm 115 will be rotated clockwise as viewed in FIG. 9 to make one complete circle. The arm will therefore move quite rapidly, and the cutter 116 will be moving very rapidly when it engages the web in the slot 104. Because of the speed of motion of the cutter 116, and the somewhat limited height of the cutter 116, it will be understood that there is no substantial motion of the web with respect to the cutter 116 while the cutter 116 is in the plane of the web. Rather, the cutter passes very quickly through the web, and carries the scrap to a point below the web so the scrap can be discharged through the pipe 105. The arm is braked by the clutch and brake 109 to be ready for the next cycle.

Those skilled in the art will realize that the clutch and brake system disclosed constitutes one of several means for operation of the punch, and that other, equivalent, apparatus can be equally well used. A purely mechanical device such as one of the well-known intermittent motion devices can be used; for a more sophisticated version, a stepping motor can be used; and, a servo motor under computer control can be used.

Thus, the particular means for operation of the punch is not limited to the apparatus shown, though the clutch and brake is the presently preferred embodiment considering both ease of operation and economy in construction.

It should be noted in FIG. 9 of the drawings that the cutter 116 has a plurality of small teeth on its cutting edge. It is believed that these teeth serve to penetrate the web quickly and easily with virtually no stretching of the web. The speed of the cutter then continues to remove the section of web and provide the desired hole.

The punching apparatus of the present invention therefore provides a very effective means to punch holes in the edges of webs without stopping the motion of the webs. The web is supported only by the rollers such as the infeed rollers 101 and 102 and the outfeed rollers 119 and 120. The web can therefore move very rapidly, and the punch is passed quickly through the moving web.

In the event the hole is punched off-center of the bag, the punch delay 34 can be used to change the location of the punch. When the measuring wheel 31 signals the punch to cut a hole, the punch delay 34 will simply delay the operation of the punch after the signal is given by the wheel 31. By setting the desired delay time, the distance can be changed as may be appropriate.

When the photocell 32 activates the punch, it will be understood that the location of the hole can be changed by changing the location of the photocell 32. This is because the photocell signals the punch when the photocell reads a spot on the web, and varying the position of the photocell must vary the position of the hole. To effect the change of the photocell, the photocell 32 is mounted on a screw 121 rotatable by a knob 122. Rotation of the knob 122 will thus vary the position of the hole as desired.

Figure 10:
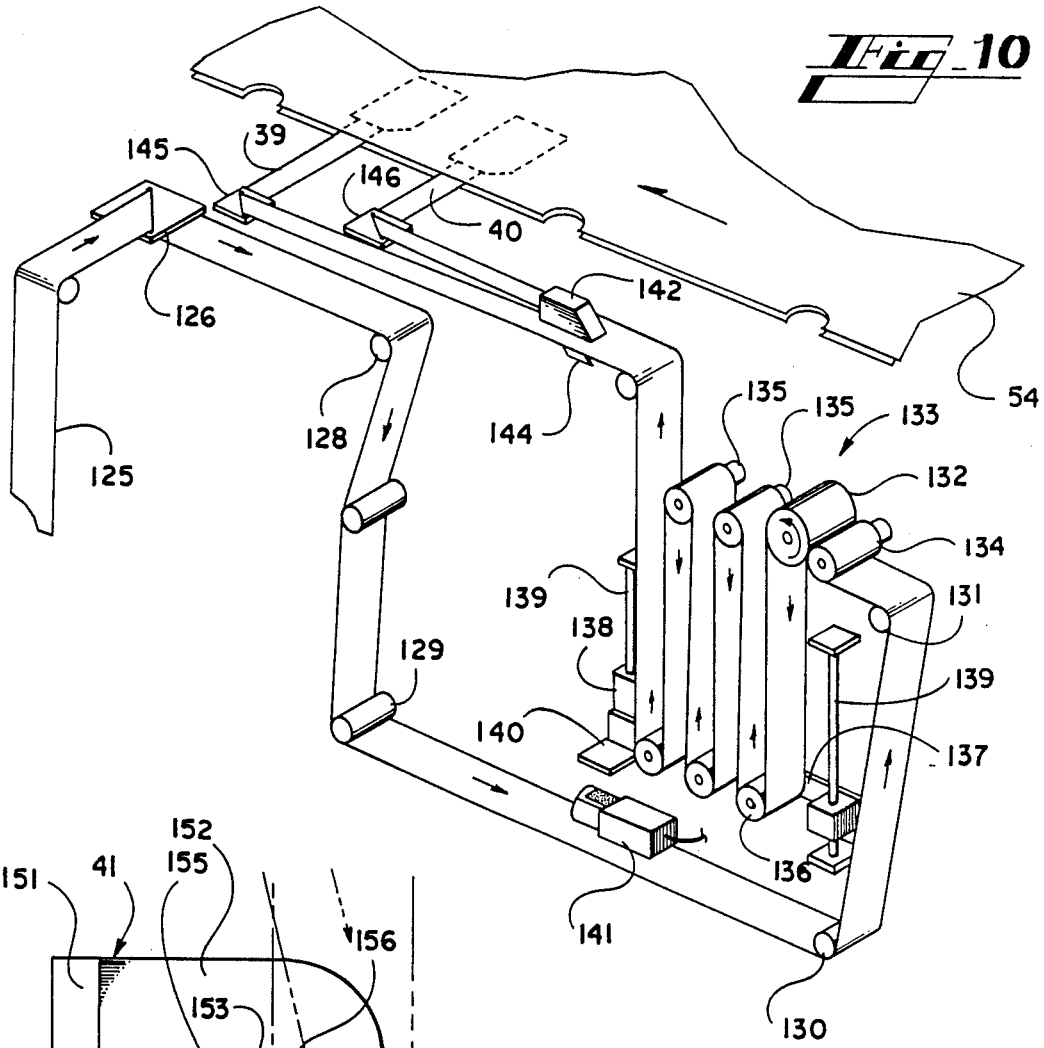
FIG. 10 is a perspective view showing the draw tape feeding and slitting system; and, FIG. 11 is a front elevational view of the tape guide for urging the tape into the hem.

Again, the description in the co-pending application should be considered. The prior application discusses the insertion of the draw tapes into the hems of the material; and the present application changes that structure only in that a large reel of strip is provided, slit, and used as the draw tape. Attention is directed to FIG. 10 of the drawings for a discussion of the strip handling apparatus.

The reel of strip is shown in FIGS. 1 and 2, and the strip 125 is shown in FIG. 10. The strip 125 is directed to a turning plate 126 which directs the strip to the right. Guide rolls 128 and 129 then direct he strip down and again to the right, whence the strip is directed up by the roll 130. The strip then turns to the left at the roll 131 and is directed to the feed roll 132 with the pressure roll 134. The feed roll 132 is also the first roll of the dancer assembly generally indicated at 133.

The devious path of the strip therefore simply provides space for the dancer 133 and the sensor to be discussed later. The feed roll 134 directs the strip to the lower, floating roll 136, from which the strip returns to the roll 135. The strip follows the sinuous path through the dancer 133.

The purpose of the dancer 133 is to maintain proper tension on the strip 125, hence on the draw tapes 39 and 40. The lower rolls 136 are connected together by a carriage 137 which has slide bearings 138 at each side thereof. The slide bearings are slidable on rods 139, and a flange 140 extends forwardly from one of the bearings 138.

Similarly to the dancer 56, there is a sound generator 141 which propagates a signal and directs the signal towards the flange 140. The flange reflects the signal to the device 141, and a control signal is thereby provided. The control signal is utilized to adjust the speed of the drive roll 132, so the height of the carriage 137 is kept constant. Since the similar arrangement was discussed for the dancer 56, this brief description should suffice.

After the strip leaves the dancer 133, the strip is turned to a horizontal direction, and the strip is engaged by a cutter 142 having a blade 144. The cutter 142 slits the strip 125 longitudinally to provide separate draw tapes of equal width. These separate draw tapes pass through turning plates 145 and 146 and enter the hems of the bag material.

Figure 11:
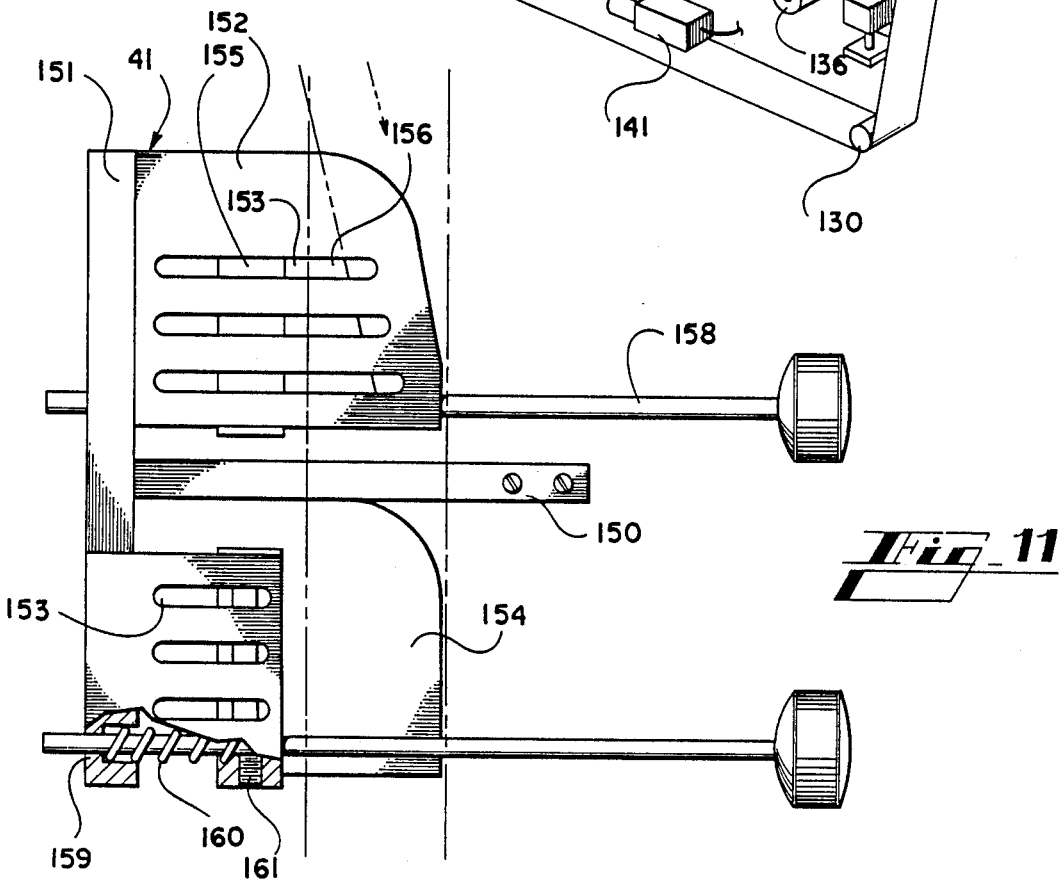

The next improvement to be described is the tape guide 41 which is shown in more detail in FIG. 11 of the drawings. The tape guide 41 urges the draw tapes 39 and 40 into the hems and places enough tension on the tape that the tape lies generally flat in the completed bag.

It will be recognized that, at this point in the system, most of the width of the bag comprises two thicknesses of material, while the hem area comprises four thicknesses of the bag material and two thicknesses of draw tape material. This excess thickness in the hem area causes a tendency for the hem side to be driven faster than the opposite side. The placing of additional tension on the draw tape has been found to alleviate the resulting problems.

In addition to the necessity for proper tension, it is important that the two draw tapes be juxtaposed. When the bag is side welded, the draw tapes are welded to each other at the same time. If the draw tapes are not welded to each other, the tapes will easily tear from the bag since the tapes are usually of thicker and stronger material than the bag.

The tape guide 41 is mounted in the decending portion of the material after the draw tapes have been inserted. A mounting member 150 is attached to the frame of the apparatus, and the vertical block 151 carries the apparatus from the member 150. Front and rear guide plates 152 and 154 extend to the right as shown. It will be understood that a plate 152 is on one side of the draw tape, and a plate 154 is on the opposite side of the plate. A slidable guide 156 is therebetween to urge the tape into the hem.

The guide plates 152 and 154 are stationary with respect to the vertical block 151, while the guide 156 is slidable therebetween. The guide 156 is carried by a slide block 155 which is guided by projections into the slots 153. The slide block 155 is selectively movable by means of the shaft 158 which is slidable in the hole 159 in the vertical block 151. A spring 160 urges the slide block 155 to the right, and the set screw 161 fixes the shaft 158 to the slide block 155 for operation therewith.

From the foregoing description, it should be understood that the shaft 158 can be moved to the left as viewed in the drawings, and a slot to receive the draw tape will be provided. When the shaft 158 is released, the spring 160 will urge the slide 156 to the right, urging the tape to the right and into the hem. The hem is shown in phantom for a clear understanding. It should also be realized that there is one set of front and rear plates 152 and 154 for each of the hems in the bag material. Two have been shown somewhat in the drawings, but both have not been shown in detail for simplicity, the front of one being shown along with the back of the other. The total showing is thought to be clear enough for full comprehension.

It will now be understood that the present invention comprises several improvements over the prior, copending application. The system can be used with either in-line systems or off-line systems, and various equipment can be used for good quality bags in either system.

It will of course be understood by those skilled in the art that the particular embodiments of the invention here presented are by way of illustration only, and are meant to be in no way restrictive; therefore, numerous changes and modification may be made, and the full use of equivalents resorted to, without departing from the spirit or scope of the invention as outlined in the appended claims.

We claim:

1. A punch for cutting holes in the edge of thermoplastic sheet material, said punch including a plurality of roller means for supporting a continuously moving web of sheet material and for moving said sheet material along a path, a cutter disposed adjacent to an edge of said path, at least one roller means of said plurality of roller means being disposed before and after said cutter for suspending a length of said sheet material therebetween, a rotatable arm carrying said cutter, said arm being oriented generally perpendicularly to said path, a cutter shaft mounting said rotatable arm, said cutter shaft having its axis generally parallel to said path and perpendicular to said cutter arm so that rotation of said cutter shaft causes rotation of said arm to carry said cutter through said length of said sheet material moving along said path, the arrangement being such that said cutter moves at sufficient speed to cut said sheet material while said sheet material is supported only by being suspended between said roller means.

2. A punch as claimed in claim 1, said cutter having a rest position wherein said cutter is disposed below said path, said rotatable arm being rotatable to carry said cutter initially downwardly so that said cutter moves through more than half a circle before engaging said sheet material.

3. A punch as claimed in claim 2, and further including a clutch having an input shaft and an output shaft, a motor drivingly connected to said input shaft, said output shaft being drivingly connected to said cutter shaft, and signal means for actuating said clutch.

* * * * *